US011220657B2

(12) United States Patent
Pelletier et al.

(10) Patent No.: US 11,220,657 B2
(45) Date of Patent: Jan. 11, 2022

(54) SOLID PERFUME COMPOSITION DELIVERING SOFTENING

(71) Applicant: Henkel IP & Holding GmbH, Duesseldorf (DE)

(72) Inventors: Maxime Pelletier, Sandy Hook, CT (US); Daniel Thomas Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 86 days.

(21) Appl. No.: 16/731,676

(22) Filed: Dec. 31, 2019

(65) Prior Publication Data

US 2021/0198600 A1 Jul. 1, 2021

(51) Int. Cl.

| | |
|---|---|
| ***C11D 3/37*** | (2006.01) |
| ***C11D 3/50*** | (2006.01) |
| ***C11D 3/06*** | (2006.01) |
| ***C11D 11/00*** | (2006.01) |
| ***C11D 3/00*** | (2006.01) |
| ***C11D 3/12*** | (2006.01) |
| ***C11D 3/22*** | (2006.01) |

(52) U.S. Cl.

CPC ..... *C11D 3/505* (2013.01); *C11D 3/0021* (2013.01); *C11D 3/06* (2013.01); *C11D 3/124* (2013.01); *C11D 3/222* (2013.01); *C11D 3/3742* (2013.01); *C11D 3/3769* (2013.01); *C11D 11/0017* (2013.01); *C11D 11/0082* (2013.01)

(58) Field of Classification Search

CPC ..... C11D 11/0017; C11D 3/50; C11D 3/2075; C11D 17/044; C11D 3/227; C11D 3/2079

See application file for complete search history.

(56) References Cited

U.S. PATENT DOCUMENTS

| | | | | |
|---|---|---|---|---|
| 6,024,943 | A | 2/2000 | Ness et al. | |
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 8,426,353 | B2 | 4/2013 | Ouali et al. | |
| 2006/0030513 | A1* | 2/2006 | Binder | C11D 3/373 510/515 |
| 2011/0224127 | A1 | 9/2011 | Blyth et al. | |
| 2012/0137338 | A1 | 5/2012 | Driggs et al. | |
| 2013/0326824 | A1* | 12/2013 | Somerville Roberts | C11D 3/2093 8/137 |
| 2017/0218312 | A1* | 8/2017 | Panandiker | C11D 1/29 |
| 2019/0119608 | A1 | 4/2019 | Schmiedel et al. | |

FOREIGN PATENT DOCUMENTS

| | | |
|---|---|---|
| EP | 3074497 B1 | 5/2017 |
| EP | 3074495 B1 | 7/2017 |
| EP | 3074496 B1 | 7/2017 |
| EP | 2922936 B1 | 8/2019 |

* cited by examiner

*Primary Examiner* — John R Hardee

(74) *Attorney, Agent, or Firm* — Bojuan Deng

(57) ABSTRACT

Solid particulate compositions for fabric treatment having at least one cationic polymer, at least one water-soluble carrier, at least one fragrance, at least one buffer system, and other optional ingredients. During a wash cycle, the compositions deliver softening to the fabrics. The disclosure further provides a method of making a solid particulate composition for fabric treatment including: mixing a water-soluble solid carrier and a buffer system to form a mixture; wherein the solid carrier is an aqueous salt having a water vapor partial pressure at a temperature from about 30° C. to about 100° C. that corresponds to the water vapor partial pressure of a saturated solution of the salt at the same temperature; adding a cationic polymer and a fragrance into the mixture; mixing the mixture; heating the mixture and obtaining a melt thereby; and cooling and shaping the melt into individual particles including melt bodies.

19 Claims, No Drawings

SOLID PERFUME COMPOSITION DELIVERING SOFTENING

FIELD OF THE INVENTION

This application relates to fragranced compositions for fabric treatment that contain a cationic polymer, and methods for the use and manufacture thereof.

BACKGROUND OF THE INVENTION

When treating and/or laundering fabrics, consumers often want not only to wash, clean or maintain the fabrics to be treated, but also to have additional benefits. For example, consumers prefer that, following washing with laundry detergent and/or fabric softener(s), and drying, the fabrics smell pleasant and feel soft. Consumers can choose detergents and/or fabric softeners having ingredients that provide some softening. However, consumers may desire greater degrees of softening than commercially available detergents and/or fabric softeners may provide.

Accordingly, a need exists for fabric softening that is better than softening provided by currently available detergents and/or fabric softeners Softening ingredients, and other beneficial ingredients are typically included as an integral component of a washing or cleaning agent. However, the ability to separately meter a solid composition comprising one or more beneficial agents into the washing drum at the start of a washing cycle allows consumers to control the amount of benefit agent provided to the laundry through customized metering. For example, solid compositions comprising melt bodies containing fragrance are already available to consumers. Consumers can add varying amounts of this solid composition to the washing drum to meter the amount of fragrance delivered to laundry. However, these compositions do not provide additional softening to fabrics.

Accordingly, need exists for solid compositions that effectively deliver softness to fabrics in the presence of a detergent during a wash cycle.

BRIEF SUMMARY OF THE INVENTION

The compositions and methods provided in the present disclosure are exemplary and are not intended to limit the scope of the claims.

The present inventors surprisingly found that the compositions of the present disclosure significantly boost the softness of fabrics or textiles compared to the softness of fabrics or textiles that were not treated with the compositions of the present disclosure.

In one aspect, the present disclosure provides a composition for fabric treatment comprising at least one cationic polymer, at least one water-soluble carrier, at least one fragrance, and at least one buffer system.

In one aspect, the cationic polymer is present in the composition for fabric treatment at an amount of from about 0.25% to about 2.5%.

In one aspect, the composition further comprises a silicone.

In another aspect, the composition for fabric treatment further comprises silicone.

In another aspect, the composition for fabric treatment further comprises a rheology modifier.

In another aspect, the composition for fabric treatment further comprises an emulsifying substance.

In another aspect, the composition for fabric treatment further comprises a colorant.

In another aspect, the composition for fabric treatment further comprises a bittering agent.

In another aspect, the composition for fabric treatment further comprises a solvent.

In another aspect, the composition for fabric treatment further comprises water.

In another aspect, the disclosure provides a method of making a solid, particulate composition for fabric treatment, comprising: mixing a water-soluble solid carrier and a buffer system to form a mixture; wherein the solid carrier is an aqueous salt having a water vapor partial pressure at a temperature of from about 30° C. to about 100° C. that corresponds to the water vapor partial pressure of a saturated solution of the salt at the same temperature; adding a cationic polymer and a fragrance into the mixture; mixing the mixture; heating the mixture and obtaining a melt thereby; and cooling and shaping the melt into individual particles comprising melt bodies.

In another aspect, the disclosure provides a method of delivering softening to a textile comprising contacting the textile with a composition for fabric treatment of the present disclosure.

DETAILED DESCRIPTION OF THE INVENTION

Definitions

All of the various aspects, aspects, and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing," and the like mean "comprising."

The act of treating a textile can refer to, for example, one or more of: i) softening a textile; ii) applying a perfume to a textile; iii) applying a perfume to and softening a textile; iv) rendering the textile resistant to static build up during drying; or any combination thereof.

Some inventive aspects contemplate numerical ranges. Every numerical range provided herein includes the range endpoints as individual inventive aspects. When a numerical range is provided, all individual values and sub-ranges therein are present as if explicitly written out.

The terms "textile" and "fabric" can be used interchangeably.

The terms "fragrance" and "perfume" can be used interchangeably.

The term "about" is synonymous with the term "approximately," and includes the recited number ±10% or ±5%. For example, "about 10" means 9 to 11. Also as an example, a temperature of approximately 50° C. means 45-55° C., or 47.5° C.-52.5° C. Unless indicated otherwise, all percentages indicated are percentage by weight.

The term "at least one," refers to one or more, for example 1, 2, 3, 4, 5, 6, 7, 8, 9 or more. In particular, this information refers to the type of agent/compound and not to the absolute number of molecules. "At least one fragrance" therefore means that at least one type of fragrance is included, but that two or more different types of fragrances may also be included.

The term "water-soluble" refers to solubility in water at 20° C. of at least 1 g/L, or at least 10 g/L, or at least 50 g/L.

The term "melt" is synonymous with "melt dispersion." The term "melt" refers to the liquid state of the composition disclosed herein, before it is cooled. The melt and/or melt dispersion is the liquid state of matter of the composition for fabric treatment disclosed herein. Following cooling, the melt becomes a solid composition for fabric treatment.

The term "melt body" is used herein to describe the solid particles than can be obtained from the liquid composition through solidification/shaping when it is cooled.

The terms "composition for fabric treatment," and "CFT" may be used synonymously with the term "melt body."

The term "melting temperature" refers to the temperature at which a composition converts from a solid form to a liquid form.

Compositions for Fabric Treatment ("CFTs")

The present disclosure provides a composition for fabric treatment ("CFT"). The CFTs can be used, for example, to treat a textile.

The CFTs described herein can be used, for example, optionally with a laundry detergent, in the washing cycle of a laundry or fabric cleaning method and can provide softening to a fabric at any time during the fabric cleaning method, including at the beginning of the fabric cleaning method. The CFTs can further provide other beneficial ingredients including, but not limited to fragrance, to the washed fabrics. A method for treating textiles or fabrics, during which a composition of the present disclosure is added into a washer containing said textiles or fabrics, is a further subject of this application.

The CFT of the present disclosure comprises melt bodies.

In one aspect, the melt bodies can be between about 0.5 mm and about 10 mm, or between about 0.8 mm to about 7 mm, or about 1 mm to about 3 mm in any spatial direction.

In one aspect, the melt bodies can have a particle weight of between about 2 mg and about 150 mg, or between about 4 mg and about 60 mg, or between about 5 mg and about 10 mg.

The melt bodies are desirably solid at room temperature, for example, at about 25° C., and soluble in the usual working temperature ranges of a wash and/or rinse cycle, and can deliver a color fading protection to fabrics during a wash cycle.

In one aspect, the melt bodies are solid at temperatures from about 20° C. to about 40° C. In one aspect, the melt bodies are solid at temperatures of about 20° C., 25° C., 30° C., 35° C., or 40° C.

In one aspect, the melt bodies are uncoated, coated, waxed, powdered, or a combination thereof.

In one aspect, a method of making the melt bodies comprises: mixing a water-soluble carrier and a buffer system to form a mixture; adding a cationic polymer and a fragrance into the mixture; mixing the mixture; heating the mixture and obtaining a melt thereby; and cooling the mixture. In one aspect, the melt is shaped into individual particles comprising melt bodies. In one aspect, the viscosity of the mixture or melt, prior to cooling, is between about 1,000 mPas and about 10,000 mPas.

The melt bodies, can be of any desired shape. The shaping takes place before the melt is cooled. Solid, particulate shapes such as substantially spherical, hemi-spherical, lentil shaped, oblong shaped, figure-like, flake-shaped, cuboid, cylindrical, cone-shaped, spherical-cap-shaped or lens-shaped, hemispherical, disk-shaped or needle-shaped particles are suitable for SCTFs of the disclosure. For example, the particles may have a gummy-bear, figure-like design. Melt bodies having a hemispherical shape can advantageously be prepared by means of pastillation.

In one aspect, the melt bodies are uncoated, coated, waxed, powdered, or a combination thereof. Coatings known from the pharmaceutical literature, for example, are suitable as a coating agent. However, the CFTs may also be waxed, i.e. coated in a wax, or powdered with a powdered material, such as a release agent, for protection from caking (agglomeration). In one aspect, the coating does not contain PEG in a significant amount (>1% by weight based on the coating).

In one aspect, the melt bodies of the present disclosure can be used to deliver softening to textiles or fabrics. For example, the CFTs of the present disclosure can be combined with a conventional washing or cleaning composition and brought into contact with the textiles or fabrics during the washing cycle of a conventional washing and cleaning process to deliver softening and fragrance to the washed textiles.

Methods for preparing the melt bodies of the present disclosure are described in U.S. patent application Ser. No. 16/162,640, published as U.S. Application Publication Number 2019/0119608, which is incorporated by reference herein in its entirety.

In one aspect, the CFT of the present disclosure can be in the form of a pastille, a granule, a pellet, a powder, a pulverized powder, or a tablet. To make tablets or pellets, the ingredients in the CFTs can be blended together, for example, at room temperature, and compressed to form tablets or pellets. The blends can be dry powder blends. The CFT may be in an amorphous form, a crystalline form, or a partially crystalline form.

In some aspects, the CFT of the present disclosure may comprise some or all of the ingredients listed below.

Cationic Polymer(s)

In one aspect, the CFT of the present disclosure can include a cationic polymer.

The cationic polymer in the CFT of the present disclosure imparts softness to fabrics washed with the CFT.

In one aspect, the cationic polymer can be a guar based cationic polysaccharide polymer. In one aspect, the guar based polysaccharide polymer can be guar 2-hydroxy-3-(trimethylammonium) propyl ether salt.

In one aspect, the cationic polymer can be a cellulosic based cationic polysaccharide polymer. In one aspect, the cellulosic based cationic polysaccharide polymer can be hydroxyethyl cellulose, poly(ethylene oxide), cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethylammonio)propyl ether salt, polyquaternium-4, polyquaternium-10, polyquaternium-24, polyquaternium-67, and mixtures thereof.

In one aspect, the cationic polymer can be a cationic non-saccharide polymer. In one aspect, the cationic non-saccharide polymer can be selected from the group comprising diallyl quaternary ammonium-containing polymers and homo or copolymers of dimethylaminoethyl(meth)acrylate, polyquaterium-7 (copolymer of acrylamide and the quaternary ammonium salt diallyldimethylammonium chloride), diethylaminoethyl(meth)acrylate or tert-butylaminoethyl(meth)acrylate in their quaternary or protonated amine form, and mixtures thereof.

In one embodiment, the cationic polymer can be present in an amount of from about 0.1% to about 2% by weight, or from about 0.15% to about 1.5% by weight, or from about 0.15% to about 1.0% by weight, or from about 0.15% to about 0.75% by weight, or from about 0.15% to about 0.5% by weight, or from about 0.1% to about 0.35% by weight, or from about 0.15% to about 0.35% by weight of the CFT.

In one embodiment, the cationic polymer can be present in an amount of about 0.15% by weight, or about 0.20% by weight, or about 0.25% by weight, or about 0.30% by weight, or about 0.35% by weight, or about 0.40% by weight, or about 0.45% by weight, or about 0.5% by weight, or about 0.6% by weight, or about 0.7% by weight, or about 0.8% by weight, or about 0.9% by weight, or about 1.0% by weight, or about 1.2% by weight, or about 1.4% by weight, or about 1.6% by weight, or about 1.8% by weight, or about 2.0% by weight, or about 2.5% by weight of the CFT, or a range between any two of the preceding values.

Water Soluble Carrier(s)

In one aspect, the CFT of the present disclosure can include a water-soluble carrier that is an aqueous salt wherein the water vapor partial pressure at a temperature of from about 30° C. to about 100° C., or usual working temperature ranges in a wash and/or rinse cycle, corresponds to the water ($H_2O$) partial pressure of the saturated solution of the salt. The water-soluble carriers of the present disclosure demonstrate this behavior at a temperature of from about 30° C. to about 100° C., or from about 40° C. to about 90° C., or from about 50° C. and about 85° C., or from about 55° C. and about 80° C. The water soluble carrier is described in U.S. patent application Ser. No. 16/162,640, published as U.S. Application Publication Number 2019/0119608, which is incorporated by reference herein in its entirety.

In one aspect, the CFT of the present disclosure can include a water soluble carrier. In one aspect, the water-soluble carrier can be an aqueous salt. In one aspect, the water-soluble carrier can be sodium acetate or a hydrate thereof. In one aspect, water-soluble carrier can be water free sodium acetate. In one aspect, the water-soluble carrier can be sodium acetate trihydrate ($Na(CH_3COO).3H_2O$), sodium sulfate ($Na_2SO_4$. $10H_2O$), trisodium phosphate dodecahydrate ($Na_3PO_4.12H_2O$) and strontium chloride hexahydrate ($SrCl_2.6H_2O$).

In one aspect, the water-soluble carrier is sodium acetate trihydrate ($Na(CH_3COO).3H_2O$).

In another aspect, the water-soluble carrier is water-free sodium acetate. In one aspect the water-free sodium acetate is used in combination with free water. In one aspect, sodium acetate trihydrate can form in situ when water-free sodium acetate is used in combination with free water. In such aspects, the water can be used in a substoichiometric or hyperstoichiometric amount based on the amount that is necessary to convert all of the sodium acetate into sodium acetate trihydrate, for example, in an amount of at least about 60% by weight, or at least about 70% by weight, or at least about 80% by weight, or at least about 90% by weight, or at about 100% by weight, or more, based on the weight of the CFT, which is the amount that is theoretically necessary to convert all of the sodium acetate into sodium acetate trihydrate ($Na(CH_3COO).3H_2O$).

In one aspect, the CFT comprises water in a hyperstoichiometric amount. Accordingly, if one aspect in which water-free sodium acetate is used in isolation, or in combination with a hydrate thereof, the trihydrate water is also used, the amount of water corresponding to at least the amount that would be stoichiometrically necessary to ensure that at least about 60% by weight of the total amount of sodium acetate and the hydrates thereof, preferably about 70% by weight, or at least about 80% by weight, or at least about 90% by weight, or at least about 100% by weight, based on the weight of the CFT, is in the form of sodium acetate trihydrate. In one aspect, the amount of water exceeds the amount that would be theoretically necessary to convert all of the sodium acetate into the corresponding trihydrate. This means, for example, that a composition that contains 50% by weight water-free sodium acetate and no hydrate thereof contains at least 19.8% by weight water (60% of 33% by weight that would be theoretically necessary to convert all of the sodium acetate into sodium acetate trihydrate.

In one aspect, the water soluble carrier can be present in an amount of from about 10% by weight to about 95% by weight, or from about 10% by weight to about 90% by weight, or from about 10% by weight to about 85% by weight, or from about 10% by weight to about 80% by weight, or from about 10% by weight to about 75% by weight, or from about 10% by weight to about 70% by weight, or from about 10% by weight to about 60% by weight, or from about 20% by weight to about 95% by weight, or from about 25% by weight to about 95% by weight, or from about 30% by weight to about 95% by weight, or from about 35% by weight to about 95% by weight, or from about 40% by weight to about 90% by weight, or from about 45% by weight to about 90% by weight of the CFT.

Fragrance(s) or Perfume(s)

In one aspect, the CFT of the present disclosure comprises at least one fragrance. In one aspect, the fragrance has a melting point that is in the range of from about −100° C. to about 100° C., or from about −80° C. to 80° C., or from about −20° C. to about 50° C., or from about −30° C. to about 20° C. In one aspect, the CFT comprises a fragrance having a melting point that is in the range of from about 25° C. to 400° C., or from about 50° C. to about 380° C., or from about 75° C. to about 350° C., or from about 100° C. to about 330° C.

In one aspect, the fragrance can be an ester, an ether, an aldehyde, a ketone, an alcohol, a hydrocarbon, an essential oil, and a combination thereof.

In one aspect, the fragrance can be, for example, adoxal (2,6,10-trimethyl-9-undecenal), anisaldehyde (4-methoxybenzaldehyde), cymal (3-(4-isopropyl-phenyl)-2-methylpropanal), ethylvanillin, florhydral (3-(3-isopropylphenyl) butanal), helional (3-(3,4-methylenedioxyphenyl)-2-methylpropanal), heliotropin, hydroxycitronellal, lauraldehyde, lyral (3- and 4-(4-hydroxy-4-methylpentyl)-3-cyclohexene-1-carboxaldehyde), methyl nonyl acetaldehyde, lilial (3-(4-tert-butylphenyl)-2-methylpropanal), phenyl acetaldehyde, undecylenaldehyde, vanillin, 2,6,10-trimethyl-9-undecenal, 3-dodecen-1-al, alpha-n-amylcinnamaldehyde, melonal (2,6-dimethyl-5-heptenal), 2,4-dimethyl-3-cyclohexene-1-carboxaldehyde (triplal), 4-methoxybenzaldehyde, benzaldehyde, 3-(4-tert-butylphenyl)propanal, 2-methyl-3-(para-methoxyphenyl)propanal, 2-methyl-4-(2,6,6-timethyl-2(1)-cyclohexen-1-yl)butanal, 3-phenyl-2-propenal, cis-/trans-3,7-dimethyl-2,6-octadien-1-al, 3,7-dimethyl-6-octen-1-al, [(3,7-dimethyl-6-octenyl) oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo [5.2.1.0(2,6)]decylidene-8)butanal, octahydro-4,7-methano-1H-indenecarboxaldehyde, 3-ethoxy-4-hydroxybenzaldehyde, para-ethyl-alpha,alpha-dimethylhydrocinnamaldehyde, alpha-methyl-3,4-(methylenedioxy)hydrocinnamaldehyde, 3,4-methylenedioxybenzaldehyde, alpha-n-hexylcinnamaldehyde, m-cymene-7-carboxaldehyde, alpha-methyl phenylacetaldehyde, 7-hydroxy-3,7-dimethyloctanal, undecanal, 2,4,6-trimethyl-3-cyclohexene-1-carboxaldehyde, 4-(3)(4-methyl-3-pentenyl)-3-cyclohexenecarboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methylundecanal, 2-methyl decanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanoindane-1- or -2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyloctanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindane-1-carboxaldehyde, 2-methyloctanal, alpha-methyl-4-(1-methylethyl)benzene acetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methyl nonyl acetaldehyde, hexanal and trans-2-hexenal.

In one aspect, the fragrance can be, for example, methyl beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyl dihydrojasmonate, menthone, carvone, camphor, koavone (3,4,5,6,6-pentamethylhept-3-en-2-one), fenchone, alpha-ionone, beta-ionone, gamma-methyl ionone, fleuramone (2-heptylcyclopentanone), dihydrojasmone, cis-jasmone, Iso E Super (1-(1,2,3,4,5,6J,8-octahydro-2,3,8,8-tetramethyl-2-naphthalenyl)ethan-1-one (and isomers)), methyl cedrenyl ketone, acetophenone, methyl acetophenone, para-methoxyacetophenone, methyl beta-naphtyl ketone, benzyl acetone, benzophenone, para-hydroxyphenylbutanone, celery ketone (3-methyl-5-propyl-2-cyclohexenone), 6-isopropyldecahydro-2-naphtone, dimethyl octenone, frescomenthe (2-butan-2-ylcyclohexan-1-one), 4-(1-ethoxyvinyl)-3,3,5,5-tetramethylcyclohexanone, methyl heptenone, 2-(2-(4-methyl-3-cyclohexen-1-yl)propyl)cyclopentanone, 1-(p-menthen-6(2)yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)indanone, 4-damascol, dulcinyl(4-(1,3-benzodioxol-5-yl)butan-2-one), Hexalon (1-(2,6,6-trimethyl-2-cyclohexen-1-yl)-1,6-heptadien-3-one), isocyclemone E (2-acetonaphthone-1,2,3,4,5,6,7,8-octahydro-2,3,8,8-tetramethyl), methyl nonyl ketone, methyl cyclocitrone, methyl lavender ketone, orivone (4-tert-amylcyclohexanone), 4-tert-butylcyclohexanone, delphone (2-pentyl cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentan-1-one), 2,4,4,7-tetramethyloct-6-en-3-one and tetrameran (6,10-dimethylundecen-2-one).

In one aspect, the fragrance can comprise, for example, 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 3-phenylpropanol, 4-heptenol, 4-isopropylcyclohexanol, 4-tert-butylcyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, ß-terpineol, butyl salicylate, citronellol, cyclohexyl salicylate, decanol, dihydromyrcenol, dimethyl benzyl carbinol, dimethyl heptanol, dimethyloctanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylat, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

In one aspect, the fragrance can be, for example, for example, benzyl acetate, phenoxyethyl isobutyrate, p-tert-butylcyclohexyl acetate, linalyl acetate, dimethyl benzyl carbinyl acetate (DMBCA), phenyl ethyl acetate, benzyl acetate, ethylmethylphenyl glycinate, allyl cyclohexyl propionate, styralyl propionate, benzyl salicylate, cyclohexyl salicylate, floramat, melusat and jasmacyclat.

In one aspect, the fragrance can be, for example, for example, benzyl ethyl ether and ambroxan. The hydrocarbons include mainly terpenes, such as limonene and pinene.

In one aspect, the fragrance can be a mixtures of various fragrances, which can be referred to as a perfume or perfume oil. Perfume oils of this kind may also contain natural fragrance mixtures, as are obtainable from plant sources.

In one aspect, the fragrance can be, for example, essential oils such as angelica root oil, anise oil, arnica blossom oil, basil oil, bay oil, champaca blossom oil, citrus oil, silver fir oil, silver fir cone oil, elemi oil, eucalyptus oil, fennel oil, pine needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, canaga oil, cardamom oil, cassia oil, pine needle oil, copaiba balsam oil, coriander oil, spearmint oil, caraway oil, cumin oil, labdanum oil, lavender oil, lemongrass oil, lime blossom oil, lime oil, mandarin oil, balm oil, mint oil, musk seed oil, muscatel oil, myrrh oil, clove oil, neroli oil, niaouli oil, olibanum oil, orange blossom oil, orange oil, origanum oil, palmarosa oil, patchouli oil, peru balsam oil, petitgrain oil, pepper oil, peppermint oil, pimento oil, pine oil, rose oil, rosemary oil, sage oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil and ambrettolide, ambroxan, alpha-amylcinnamaldehyde, anethol, anisaldehyde, anise alcohol, anisol, anthranilic acid methyl ester, acetophenone, benzyl acetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptine carboxylic acid methyl ester, heptaldehyde, hydroquinone dimethyl ether, hydroxycinnamaldehyde, hydroxycinnamyl alcohol, indol, irone, isoeugenol, isoeugenol methyl ether, isosafrole, jasmone, camphor, carvacrol, carvone, p-cresol methyl ether, cumarin, p-methoxyacetophenone, methyl n-amyl ketone, methyl anthranilic acid methyl ester, p-methyl acetophenone, methyl chavicol, p-methyl quinoline, methyl beta-naphthyl ketone, methyl n-nonyl acetaldehyde, methyl n-nonyl ketone, muscone, beta-naphthol ethyl ether, beta-naphthol methyl ether, nerol, n-nonyl aldehyde, nonyl alcohol, n-octyl aldehyde, p-oxy-acetophenone, pentadecanolide, beta-phenyl ethyl alcohol, phenyl acetic acid, pulegone, safrole, salicylic acid isoamyl ester, salicylic acid methyl ester, salicylic acid hexyl ester, salicylic acid cyclohexyl ester, santalol, sandelice, skatole, terpineol, thymene, thymol, troenan, gamma-undelactone, vanillin, veratrum aldehyde, cinnmaldehyde, cinnamyl alcohol, cinnamic acid, cinnamic acid ethyl ester, cinnamic acid benzyl ester, diphenyl oxide, limonene, linalool, linalyl acetate and propionate, melusat, menthol, menthone, methyl n-heptenone, pinene, phenyl acetaldehyde, terpinyl acetate, citral, citronellal, and mixtures thereof.

In one aspect, the fragrance can have, for example, a musky scent, a pungent scent, a camphoraceous scent, an ethereal scent, a floral scent, a peppermint scent, or any combination thereof.

In one aspect, the fragrance can comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In one aspect, the fragrance can comprise a linear terpene, a cyclic terpene, an aromatic compound, a lactone, a thiol, or any combination thereof.

In one aspect, fragrance or perfume is High Five ACM 190991 F (Firmenich), Super Soft Pop 190870 (Firmenich), Mayflowers TD 485531 EB (Firmenich), Popscent 259366 (Firmenich), Azulete Neat Oil 495389 (Firmenich), Tackle Haloscent MOCR ACM (Firmenich), Sonic Boom Pastille UAH (Firmenich), Maxwell Popscent ACM (Firmenich), Perf Sonic Boom Pastille (Firmenich), Perf Hydro Power Cap (Firmenich), or any combination thereof. Other art-known fragrances, or any fragrance commercially available from a fragrance supplier (for example, Firmenich, Givaudan, International Flavors and Fragrances (IFF), Oriental etc.), or combinations of such fragrances, may also suitably be used in the CFTs, compositions, and methods disclosed herein.

In one aspect, the fragrance can be a fragrance precursor. "Fragrance precursor" refers to compounds which only release the actual fragrance following chemical conversion/separation, for example, when exposed to light or other environmental conditions, such as pH, temperature, etc. Compositions of this kind are often referred to as pro-fragrances.

In one aspect, at least some of the fragrance can be encapsulated, for example, in a microcapsule or a nanocapsule. The microcapsules and nanocapsules can be water-soluble or water-insoluble. In one aspect, all of the fragrance is encapsulated. Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

In one aspect, the fragrance is present in the CFT in an amount from about 0.1% by weight to about 25.0% by weight, or from about 0.1% by weight to about 20% by weight, or from about 0.5% by weight to about 20% by weight, or from about 0.5% by weight to about 15% by weight, or from about 1% by weight to about 15% by weight, or from about 1% by weight to about 12% by weight, or from about 3% by weight to about 12% by weight, based on the total weight of the CFT.

Buffer System(s)

In one aspect, the CFT of the present disclosure comprises at least one buffer system. In one aspect, the buffer system(s) can be a solid buffer system, i.e. a solid (mixture) under standard conditions.

In one aspect, the buffer system can include, for example, sodium hydrogen carbonate, sodium carbonate, disodium hydrogen phosphate, sodium glutamate, sodium aspartate, tris(hydroxymethyl)aminomethane (TRIS), and combinations thereof. Additional organic and inorganic buffer substances that are known to one skilled in the art and meet the above criteria, may be suitable for use in the CFT of the present disclosure.

In one aspect, the buffer system is TRIS.

In one aspect, the buffer system has a pKa of at least about 5.75, or at least about 6.25, or at least about 6.75, and no more than about 12, or less than about 11.5, or about 11 or less, or about 10.5 or less.

In one aspect, the buffer system of the present disclosure is such that, when 1 g of the composition is dissolved in 50 g of deionized water, a pH of about 12, or of about 11.5, or of about 11, is not exceeded, and the buffer capacity of the resultant solution is at least about 2 mg HCl/g of the composition, or at least about 3 mg HCl/g of the composition, or at least about 4 mg HCl/g of the composition.

In one aspect, the buffer system can be present in an amount from about 0.1% by weight to about 10% by weight, or from about 0.5% to about 7.5% by weight, or from about 1% by weight to about 5% by weight, based on the total weight of the CFT.

Silicone

In one aspect, the CFT of the present disclosure further comprises a softening silicone.

In one aspect, the silicone may be added in amount up to about 2.5% of the CFT, based on the total weight of the composition. In such aspects, the amount of cationic polymer can be increased up to 0.5% by weight and the CFT will effectively soften a textile.

In one aspect, the silicone can comprise a non-functionalized silicone such as polydimethylsiloxane (PDMS) or alkyl or alkoxy functional silicone. In one aspect, the silicone can comprise functionalized silicone or a silicone copolymer with one or more different types of functional groups, including amino, phenyl, polyether, acrylate, siliconhydride, carboxylic acid, and quaternized nitrogen, and others.

In one aspect, the silicone can be in the form of a silicone emulsion. In one aspect, the silicone particle size can be in the range of from about 1 nm to about 100 microns, or from about 10 nm to about 10 microns. The silicone can include microemulsions (particle size <150 nm), standard emulsions (particle size of about 200 nm to about 500 nm) and/or macroemulsions (particle size of about 1 micron to about 20 microns).

In one aspect, the silicones(s) can be polydialkylsiloxanes, such as polydimethylsiloxane, amino functionalised silicones, and anionic silicones, such as carboxyl functionalised silicone. In one aspect, the silicone can be polydimethylsiloxane.

In one aspect, the silicone can be present in an amount of from about 0.1% to about 2.5% by weight, or from about 0.5% to about 2.5% by weight, or from about 1% by weight to about 2.5% by weight, or about 2% by weight of the CFT. In one aspect, the silicone can be present in an amount of about 0.1% by weight, or about 0.5% by weight, or about 1% by weight, or about 1.2% by weight, or about 1.3% by weight, or about 1.4% by weight, or about 1.5% by weight, or about 1.6% by weight, or about 1.7% by weight, or about 1.8% by weight, or about 1.9% by weight, or about 2% by weight, or about 2.1% by weight, or about 2.2% by weight, or about 2.3% by weight, or about 2.4% by weight, or about 2.5% by weight, or about 2.6% by weight, or about 2.7% by weight, or about 2.8% by weight, or about 2.9% by weight, or about 3% by weight, of the CFT, or a range between any two of the preceding values.

Rheology Modifier

In one aspect, the CFT of the present disclosure comprises at least one rheology modifier. In one aspect, the rheology modifier can be an inorganic rheology modifier and/or an organic rheology modifier.

In one aspect, the rheology modifier can be an inorganic rheology modifier such as, for example, silica. Suitable silicas include highly dispersed silicas, such as those having BET surfaces areas of more than about 50 $m^2/g$, or more than about 100 $m^2/g$, or from about 150 $m^2/g$ to about 250 $m^2/g$, or from about 175 $m^2/g$ to about 225 $m^2/g$. In one aspect, inorganic rheology modifier can be pyrogenic silica. In one aspect the rheology modifier is a highly dispersed silica having a BET surface area of between about 50 $m^2/g$ to about 225 $m^2/g$.

Suitable silicas are commercially available from Evonik under the trade names that are known in the art, such as, for example, Aerosil® and Sipernat®.

In one aspect, the rheology modifier can be an organic rheology modifier. In one aspect, the organic rheology modifier can be cellulose. A suitable cellulose microfibrillated cellulose (MFC, nanocellulose). In one aspect, the rheology modifier can be microfibrillated cellulose.

Suitable MFCs are commercially available under various trade names that are known in the art, for example, as Exilva (Borregaard) or Avicel® (FMC).

In one aspect, the CFT of the present disclosure includes at least one inorganic silica or at least one organic silica. In one aspect, the CFT of the present disclosure includes at least one inorganic silica and at least one organic silica.

In one aspect, the CFT rheology modifier is present in amounts of from about 0.1% by weight to about 40% by weight, or from about 0.5% by weight to about 25% by weight, based on the total weight of the CFT.

Emulsifying Substance(s)

In one aspect, the CFT of the present disclosure further comprises an emulsifying substance. In one aspect, the emulsifying substance can be a non-ionic surfactant, cationic surfactant, or anionic surfactant.

In one aspect, the emulsifying substance can include, for example, fatty alcohols, such as stearyl alcohol, fatty alcohol alkoxylates, such as fatty alcohol alkoxylates used as non-ionic surfactants, fatty alcohol and fatty alcohol ether sulfates and alkyl benzene sulfonates, in particular those that are also used as anionic surfactants, are suitable. Suitable fatty alcohol ethoxylates include C10-22 fatty alcohol ethoxylates having up to 50 EO, C12-18 alkyl ethers having 5-8, or 7 EO, and C16-18 alkyl ethers having up to 30 EO. Suitable fatty alcohol ether sulfates are the sulfates of the above-mentioned fatty alcohol ethers; suitable fatty alcohol sulfates are in particular C10-18 fatty alcohol sulfates and C12-16 fatty alcohol sulfates. Suitable alkyl benzene sulfonates are linear C10-13 alkyl benzene sulfonates.

In one aspect, the emulsifying substance can be fatty alcohols, fatty alcohol alkoxylates, fatty amide ethoxylates, fatty alcohol sulfates, fatty alcohol ether sulfates, alkyl benzene sulfonates, allyl polyglycosides, fatty acid sorbitan esters, alkylamine oxides, alkyl betaines or combinations thereof.

In one aspect, the emulsifying substance can be present in an amount of from about 0.01% by weight to about 20% by weight, or from about 0.10% by weight to about 15% by weight, or from about 0.10% by weight to about 10% by weight, or from about 0.15% to about 2% by weight, or from about 0.15% to about 1% by weight, or from about 0.15 to about 0.5% by weight, or from about 0.15% to about 0.4% by weight, or from about 0.15% to about 0.35% by weight or from about 0.2% by weight to about 0.4% by weight, or from about 0.2% by weight to about 0.35% by weight of the CFT.

Colorant(s)

In one aspect, the CFT of the present disclosure further comprises at least one colorant.

In one aspect, the CFT does not contain a colorant.

In one aspect, the CFT contains one or more colorants. In one aspect, the colorant can be a water-soluble polymer, water-insoluble polymer, a water-soluble dye, a water-insoluble dye, or a combination thereof.

In one aspect, the colorant(s) can be, for example, red, orange, yellow, blue, indigo, violet, or any combination thereof.

In one aspect, the colorant(s) can be Violet LS, Royal MC, Blue HP, Blue MC, Aquamarine, Green HMC, Bright Yellow, Yellow LP, Yellow BL, Brilliant Orange, Crimson, Red MX, Pink AL, Red BL, Red ST, Acid Blue 80, Acid Red 52, Acid Violet 48, Liquitint blue HP, Liquitint Bright Yellow Liquid, or a combination thereof.

In one aspect, the colorant(s) can be present in an amount of from about 0.0001% by weight to about 1.0% by weight, or from about 0.0001% by weight to about 0.5% by weight, or from about 0.001% by weight to about 0.3% by weight, or from about 0.001% by weight to about 0.1% by weight, or from about 0.001% by weight to about 0.05% by weight, or from about 0.001% by weight to about 0.025% by weight, or about 0.001% by weight, or about 0.002% by weight, or about 0.003%, or about 0.005% by weight, or about 0.01% by weight, or about 0.02% by weight, or about 0.03% by weight, or about 0.04% by weight, or about 0.05% by weight, or about 0.1% by weight of the composition.

The colorant(s) disclosed herein can include no water, or from about 1% to about 99% water by weight of the colorant. In one aspect, the colorant(s) include about 10% water by weight, about 20% water by weight, about 30% water by weight, about 40% water by weight, about 50% water by weight, about 60% water by weight, about 70% water by weight, about 80% water by weight, about 90% water by weight, about 95% water by weight, or about 99% water by weight of the colorant.

Bittering Agent(s)

In one aspect, the CFT of the present disclosure further comprises at least one bittering agent. In one aspect, the bittering agent can be denatonium benzoate.

Solvent(s)

In one aspect, the CFT of the present disclosure further comprises at least one solvent. In one aspect, the solvent can be dipropylene glycol. Dipropylene glycol is commercially available from Spectrum Chemical as Dipropylene Glycol (D1207).

Water

In one aspect, the CFT of the present disclosure further comprises free water. As used herein, "free water," refers to water that is not bound in a salt contained in the composition.

PEG(s)

In one aspect, the CFT of the present disclosure does not contain polyethylene glycol ("PEG"), in the form of a coating, that is a solid at room temperature.

In one aspect, the CFT of the present disclosure contains less than about 1% by weight of PEG, in the form of a coating, that is solid at room temperature, by weight of the composition. Suitable amounts include less than 0.9, 0.8, 0.7, 0.6, 0.5, 0.4, 0.3, 0.2, or 0.1% by weight of PEG.

Additional Solid(s) and/or Filler(s)

In one aspect, the CFT of the present disclosure comprises additional ingredient(s) known to be employed in compositions for fabric treatment.

The additional ingredient(s) can be, for example, a bleaching agent, a bleach activator, an enzyme, a silicone oil, an anti-re-deposition agent, an optical brightener, a greying inhibitor, a shrink inhibitor, an anti-creasing agent, a color transfer inhibitor, an anti-microbial, a germicide, a fungicide, an antioxidant, an anti-static agent, an ironing aid, a water proofing agent, an impregnation agent, a swelling agent, an anti-slip agent, a UV absorber, a corrosion inhibitor, or any combination thereof. In other aspects, the additive can be one or more viscosity-modifying agents (for example, silica, sodium CMC, and other agents well-known in the art to increase or decrease the viscosity of a liquid or liquid-containing suspension), one or more opacifying agents, and the like. In further aspects, the additional ingredient(s) can be scavengers, including, for example, chlorine scavengers.

The additional ingredient(s) can be, for example, a salt. Salts can include, but are not limited to, alkali metal salt, alkaline earth metal salt, and combinations thereof.

Alkali metal salts can be, for example, salts of lithium, sodium, potassium, rubidium, cesium, francium, or any combination thereof.

Useful alkali metal salts can be, for example, alkali metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkali metal salts can include, for example, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium ascorbate, or any combination thereof.

Alkaline earth metal salts include, for example, salts of beryllium, magnesium, calcium, strontium, barium, radium, or any combination thereof.

Alkaline earth metal salts can be, for example, alkaline metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkaline earth metal salts can include, for example, magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, or any combination thereof.

Salts can include, for example, inorganic salts, such as inorganic alkali metal salts and inorganic alkaline earth metal salts that do not contain carbon.

Salts can include, for example, organic salts, such as organic alkali metal salts and organic alkaline earth metal salt that contain carbon.

The additional ingredient(s) can be, for example, contained in the CFT in an amount ranging from about 0.00001% by weight to about 10% by weight, based on the weight of the CFT.

Some examples of additional ingredients can be, for example, U.S. powdered sugar 10×, DISINTEX 75, polyvinylpyrrolidone K15, sodium sulfate, and sodium chloride.

The CFT may optionally contain further typical ingredients, for example those that improve the application-specific and/or aesthetic properties.

Various formulations of a number of CFTs according to aspects of the disclosure are set forth in the following tables (numerical values are provided in wt. %, based on the total weight of the agent, unless indicated otherwise). TRIS is preferably used as the buffer system.

TABLE 1

| | Formula 1 | Formula 2 | Formula 3 | Formula 4 | Formula 5 |
|---|---|---|---|---|---|
| Cationic polymer | 0.1 to 2.5 | 0.1 to 2.0 | 0.15 to 1.5 | .25 to 1.0 | .35 to .75 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Buffer system | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 2

| | Formula 6 | Formula 7 | Formula 8 | Formula 9 | Formula 10 |
|---|---|---|---|---|---|
| Cationic polymer | 0.1 to 2.5 | 0.1 to 2.0 | 0.15 to 1.5 | .25 to 1.0 | .35 to .75 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silica | 1.0 to 2.5 | 1.0 to 2.5 | 1.0 to 2.5 | 1.2 to 2.0 | 1.2 to 2.0 |
| Buffer system | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 3

| | Formula 11 | Formula 12 | Formula 13 | Formula 14 | Formula 15 |
|---|---|---|---|---|---|
| Cationic polymer | 0.1 to 2.5 | 0.1 to 2.0 | 0.15 to 1.5 | .25 to 1.0 | .35 to .75 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| Buffer system | 0.1 to 10 | 0.25 to 8.5 | 0.5 to 7.5 | 0.75 to 6.0 | 1.0 to 5.0 |
| Silicone | 0.5 to 5.0 | 1.0 to 4.0 | 1.5 to 3.5 | 2.0 to 3.0 | 2.0 to 3.0 |
| Misc. | ad 100 | ad 100 | ad 100 | ad 100 | ad 100 |

TABLE 4

| | Formula 16 | Formula 17 | Formula 18 | Formula 19 | Formula 20 |
|---|---|---|---|---|---|
| Cationic polymer | 0.1 to 2.5 | 0.1 to 2.0 | 0.15 to 1.5 | .25 to 1.0 | .35 to .75 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fatty alcohol ethoxylate having from 5 to 50 EO | 0.1 to 10 | 0.1 to 5.0 | 0.2 to 5.0 | 0.2 to 3.0 | 0.5 to 2.0 |
| Buffer system | 0.1 to 10 | 0.25 to 8.5 | 0.5 to 7.5 | 0.75 to 6.0 | 1.0 to 5.0 |
| Silicone | 0.5 to 5.0 | 1.0 to 4.0 | 1.5 to 3.5 | 2.0 to 3.0 | 2.0 to 3.0 |
| Misc. | ad 100 | ad 100 | ad 100 | ad 100 | ad 100 |

TABLE 5

| | Formula 21 | Formula 22 | Formula 23 | Formula 24 | Formula 25 |
|---|---|---|---|---|---|
| Cationic polymer | 0.1 to 2.5 | 0.1 to 2.0 | 0.15 to 1.5 | .25 to 1.0 | .35 to .75 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate having from 5 to 50 EO | 0.1 to 10 | 0.1 to 5.0 | 0.2 to 5.0 | 0.2 to 3.0 | 0.5 to 2.0 |
| Buffer system | 0.1 to 10 | 0.25 to 8.5 | 0.5 to 7.5 | 0.75 to 6.0 | 1.0 to 5.0 |
| Silicone | 0.5 to 5.0 | 1.0 to 4.0 | 1.5 to 3.5 | 2.0 to 3.0 | 2.0 to 3.0 |
| Misc. | ad 100 | ad 100 | ad 100 | ad 100 | ad 100 |

Methods of Use

In one aspect, the present disclosure provides a method of delivering softness to a textile comprising contacting the fabric or textile with one or more melt bodies of the present disclosure.

The CFTs of the present disclosure can be used to treat fabrics or textiles, for example, to impart softness, to impart scent (i.e., apply fragrance to), or decrease static build up when the treated textile is subsequently dried. In one aspect, the present disclosure provides a method of treating a fabric or a textile comprising combining or contacting the fabric or textile to be treated, with water and a CFT. The amount of CFT can be, for example, about 0.001 g to about 1 kg per treatment. The amount of the CFT can be, for example, about 0.01 g, about 0.1 g, about 1 g, about 2 g, about 3 g, about 4 g, about 5 g, about 6 g, about 7 g, about 8 g, about 9 g, about 10 g, about 25 g, about 50 g, about 100 g, about 200 g, about 300 g, about 400 g, about 500 g, about 600 g, about 700 g, about 800 g, or about 900 g per treatment.

The CFTs can be used in a top loading or front loading washer, in hot, warm, or cold water. The CFTs and laundry compositions can be used with a detergent in a wash cycle, or separately but in conjunction with a detergent (for example, in a separate wash or rinse cycle).

In one aspect, the disclosure provides a textile treated by a CFT, as disclosed herein. The textile, after being treated, may be further processed, for example by drying, pressing, ironing, steaming, sewing, and the like.

The following examples are illustrative and do not limit the scope of the disclosure of the claims.

Example 1

The following tables contain example formulations (all figures given in % by weight).

TABLE 6

| Formula 26 | |
|---|---|
| Component | % By Weight |
| Microfibrillated cellulose (2% in water) | 23.12 |
| Na Acetate | 54.29 |
| Buffer system (e.g., TRIS) | 1.88 |
| Alkyl polyglycoside surfactant | 0.30 |
| DPG | 1.68 |
| Colorant (10% in water) | 0.03 |
| Free oil fragrance | 1.50 |
| Encapsulated Fragrance (50% active) | 6.00 |
| Bitrex 25% in PG | 0.04 |
| Cationic cellulose | 0.35 |
| Water | Remaining |

All materials are considered greater than 99% active unless stated otherwise.

TABLE 7

| Formula 27 | |
|---|---|
| Component | % By Weight |
| Microfibrillated cellulose (2% in water) | 23.12 |
| Na Acetate | 54.29 |
| Buffer system (e.g., TRIS) | 1.88 |
| Alkyl polyglycoside surfactant | 0.30 |
| DPG | 1.68 |
| Colorant (10% in water) | 0.03 |
| Free oil fragrance | 1.50 |
| Encapsulated Fragrance (50% active) | 6.00 |
| Bitrex 25% in PG | 0.04 |
| Cationic cellulose | 0.150 |
| Silicone | 2.0000 |
| Water | Remaining |

All Materials are Considered Greater than 99% Active Unless Stated Otherwise.

Two CFT formulations containing the ingredients and amounts listed in each of Tables 6 and 7 above, were prepared using the method below.

Sodium acetate trihydrate was heated to a temperature of 70° C. and stirred in water to form a mixture. The remaining ingredients were subsequently added to the mixture in the amounts listed in each of Formulas 21 and 22. Melt bodies or pastilles were prepared by dropping the liquid mixture ("melt") onto a cooling plate of which the temperature was adjusted to room temperature (23° C.).

Example 2

A softening test was designed to assess the softening effects on fabric samples after treatment of the fabrics with the composition of the present disclosure.

Softness may be described as "feel performance." Feel performance can be characterized using the Extraction Energy Test Method (EETM), using a Phabrometer instrument (Nu Cybertek, Davis, Ca), which determines the amount of energy required to extract a cotton cloth, treated or untreated, through an orifice. Less energy is required to extract a cotton terry cloth treated with a rinse-added fabric care composition than to extract an untreated cotton terry cloth. The lesser the extraction energy required, the more lubricous or "silky" a fabric likely feels.

The EETM is as follows: circles of treated fabric are die cut into 11.2 cm circles using a hydraulic press. The fabric circles are placed between two 32 mm rings on the Phabrometer. The top ring is weighted with 1.36 kg and can be varied based on fabric type. A small probe pushes the fabric through the hole in the ring (perpendicular to the fabric surface). The instrument records the force (as voltage) needed to push the fabric through the ring for a total of 120 data points. The extraction energy is the area under the voltage-time curve plot. The EETM suggests that it takes less energy to extract cotton terry cloth treated with rinse added fabric care compositions versus an untreated cotton terry cloth. As noted herein, the lower the extraction energy, the more lubricous or "silky" the fabric likely feels.

An EETM using a Phabrometer instrument was employed to determine the softening effects of the CFT of the present disclosure on cotton knit fabric samples. An untreated sample and sample washed with a pastille that did not include cationic polymers or silicones were used as negative controls. Two different pastille dosages were tested: 45 g and 20 g. Three different percentages (by weight percentage of the pastille) of cationic polymers were tested: 0.15%, 0.25%, and 0.35%. Silicone (2%) was also combined in a pastille with 0.15% cationic polymer to determine the impact of the added silicone, in combination with the cationic polymer, on the softness of the sample fabrics. The results are shown in Table 8 below in descending order of the resulting softness from softest to harshest.

TABLE 8

| Pastille Composition | Statistical Category | Least Square Mean |
|---|---|---|
| Formula 28 | A | 90.643925 |
| Formula 29 | A B | 90.333483 |
| Formula 30 | B C | 90.225917 |
| Formula 31 | C D | 89.933625 |
| Formula 32 | D E | 89.893142 |
| Formula 33 | D E | 89.779275 |
| Formula 34 | D E | 89.641433 |
| Formula 35 | E | 89.590975 |

The first column provides the pastille composition. The second column indicates the statistical category of the knit fabric sample. Fabric samples with a shared letter (e.g., AB and BC) are not statistically different from each other, and those without a shared letter (e.g., AB and DE) are statistically different from each other. The third column provides the softness score of the sample fabric as measured by the Phabrometer. Higher softness scores indicate softer samples. As shown, Formula 28 is statistically different from Formula 30 because the statistical category does not share a letter (A and BC), whereas formula 28 and 29 are not statistically different from each other because the statistical category does share a letter A (A and AB).

Samples washed with pastilles containing 0.35% cationic polymer exhibited the highest softening performance according to the Phabrometer instrument (Formulas 28 and 29). Surprisingly, 45 g of pastille containing 0.15% cationic polymer and 2% silicone (Formula 30) resulted in increased softening performance, which is not statistically different from 20 g of pastilles comprising 0.35% cationic polymer (Formula 29) but was statistically different from the control pastille (Formula 34). Samples treated with pastilles that did not include either a cationic polymer or silicone (Formula 35) exhibited lower softening performance in comparison to the samples treated with the CFT of the present disclosure.

This example demonstrates that the addition of a cationic polymer of the present disclosure had a softening impact on the sample fabrics. This example further demonstrates that the addition of a cationic polymer in combination with a silicone, as disclosed herein, had a softening impact on the samples.

All patents, patent applications, and publications cited herein are fully incorporated by reference herein in their entirety.

The foregoing description has revealed the general nature of the disclosure such that others can, by applying knowledge within the skill of the art, readily modify and/or adapt for various applications such specific aspects, without undue experimentation. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A solid, particulate composition for delivering a softening benefit to fabric in a fabric treatment comprising:

(a) at least one cationic polymer present in an amount from about 0.15% to about 0.5% by weight of the composition;

(b) at least one water-soluble solid carrier comprising sodium acetate trihydrate present in an amount from about 20% to about 95% by weight of the composition, wherein the solid carrier is an aqueous salt having a water vapor partial pressure at a temperature of from about 30° C. to about 100° C. that corresponds to the water vapor partial pressure of a saturated solution of the salt at the same temperature;

(c) at least one fragrance present in an amount from about 0.1% to about 20% by weight of the composition; and (d) at least one buffer system present in an amount from about 0.1% to about 10% by weight of the composition.

2. The composition of claim 1, wherein the cationic polymer comprises:

(a) a cellulosic based cationic polysaccharide polymer selected from the group consisting of: cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 and mixtures thereof, or (b) a non-saccharide polymer selected from the group consisting of: diallyl quaternary ammonium-containing polymers and homo or copolymers of dimethylaminoethyl (meth)acrylate, diethylaminoethyl (meth)acrylate, polyquarternium-7 (copolymer of acrylamide and the quaternary ammonium salt diallyldimethylammonium chloride), or tert-butylaminoethyl (meth)acrylate in their quaternary or protonated amine form, and mixtures thereof.

3. The composition of claim 1, wherein the fragrance is an ester, an ether, an aldehyde, a ketone, an alcohol, a hydrocarbon, an essential oil, and a combination thereof.

4. The composition of claim 1, wherein the buffer system is a solid buffer system, and wherein the buffer system is such that, when 1 g of the composition is dissolved in 50 g of deionized water, a pH of about 12 is not exceeded, and the buffer capacity of the resultant solution is from about 2 mg HCl/g of the composition to about 4 mg HCl/g of the composition.

5. The composition of claim 4, wherein the buffer system is selected from the group consisting of: sodium hydrogen carbonate, sodium carbonate, disodium hydrogen phosphate, sodium glutamate, sodium aspartate, tris(hydroxymethyl)aminomethane (TRIS), and combinations thereof.

6. The composition of claim 1, further comprising a silicone selected from the group consisting of: polydialkylsiloxanes, amino functionalised silicones, and anionic silicones, wherein the silicone is present in an amount of from about 0.1% to about 2.5% by weight of the composition.

7. The composition of claim 1, further comprising at least one rheology modifier, selected from an inorganic rheology modifier, an organic rheology modifier, and mixtures thereof, wherein the at least one rheology modifier is present in an amount of from about 0.5% by weight to about 25% by weight of the composition.

8. The composition of claim 7, wherein the inorganic rheology modifier is pyrogenic silica.

9. The composition of claim 7, wherein the organic rheology modifier is a microfibrillated cellulose.

10. The composition of claim 1, further comprising an emulsifying substance selected from the group consisting of fatty alcohols, fatty alcohol alkoxylates, fatty amide ethoxylates, fatty alcohol sulfates, fatty alcohol ether sulfates, alkyl benzene sulfonates, allyl polyglycosides, fatty acid sorbitan esters, alkylamine oxides, alkyl betaines and combinations thereof.

11. The composition of claim 10, wherein the emulsifying substance is present in an amount of from about 0.10% by weight to about 10% by weight of the composition.

12. The composition of claim 1, further comprising at least one colorant, wherein the colorant is a water-soluble polymer, water-insoluble polymer, a water-soluble dye, a water-insoluble dye, or a combination thereof.

13. The composition of claim 12, wherein the colorant is present in an amount of from about 0.001% by weight to about 0.5% by weight of the composition.

14. The composition of claim 1, further comprising denatonium benzoate as a bittering agent and dipropylene glycol as a solvent.

15. The composition of claim 1, further comprising water.

16. The composition of claim 1, wherein the composition contains less than about 1% by weight of polyethylene glycol, in the form of a coating, that is solid at room temperature.

17. The composition of claim 1, wherein the composition comprises individual particles in the form of melt bodies, wherein:

(a) the melt bodies have a particle size between about 0.5 mm and about 10 mm in any spatial direction, (b) the melt bodies have a particle weight of between about 2 mg and about 150 mg, (c) the melt bodies are solid at temperatures from about 20° C. to about 40° C., and (d) the melt bodies are in a form selected from the group consisting of a pastille, a granule, a pellet, a powder, a pulverized powder, a tablet, and a crystal.

18. A method of making a solid, particulate composition according to claim 1 for fabric treatment, comprising:

mixing said water-soluble solid carrier and said buffer system to form a mixture;

wherein the solid carrier is an aqueous salt having a water vapor partial pressure at a temperature of from about 30° C. to about 100° C. that corresponds to the water vapor partial pressure of a saturated solution of the salt at the same temperature;

adding a cationic polymer and a fragrance into the mixture;

mixing the mixture;

heating the mixture and obtaining a melt thereby; and cooling and shaping the melt into individual particles comprising melt bodies.

19. A method of delivering softening to a textile, comprising contacting the textile with the composition of claim 1 during a washing cycle.

* * * * *